US006070137A

United States Patent [19]

Bloebaum et al.

[11] Patent Number: 6,070,137

[45] Date of Patent: May 30, 2000

[54] INTEGRATED FREQUENCY-DOMAIN VOICE CODING USING AN ADAPTIVE SPECTRAL ENHANCEMENT FILTER

[75] Inventors: Leland S. Bloebaum, Cary; Phillip M. Johnson, Raleigh, both of N.C.

[73] Assignee: Ericsson Inc., Research Triangle Park, N.C.

[21] Appl. No.: 09/003,967

[22] Filed: Jan. 7, 1998

[51] Int. Cl.[7] ..... G10L 3/02; G10L 9/16

[52] U.S. Cl. ..... 704/227; 381/94.3; 704/205

[58] Field of Search ..... 704/205, 226, 704/227; 381/94.3

[56] References Cited

U.S. PATENT DOCUMENTS

| | | | |
|---|---|---|---|
| 4,628,529 | 12/1986 | Borth et al. . | |
| 4,811,404 | 3/1989 | Vilmur et al. . | |
| 5,247,579 | 9/1993 | Hardwick et al. . | |
| 5,544,250 | 8/1996 | Urbanski . | |
| 5,581,656 | 12/1996 | Hardwick et al. . | |
| 5,630,011 | 5/1997 | Lim et al. . | |
| 5,659,622 | 8/1997 | Ashley | 381/94 |
| 5,864,794 | 1/1999 | Tasaki | 704/214 |

FOREIGN PATENT DOCUMENTS

| | | | |
|---|---|---|---|
| 2144823 | 3/1995 | Canada . | |
| 0673013A1 | 10/1995 | European Pat. Off. | G10L 5/06 |
| 0722165A2 | 7/1996 | European Pat. Off. . | |
| WO94/12972 | 9/1994 | WIPO . | |
| WO 96/24128 | 8/1996 | WIPO | G10L 3/02 |

OTHER PUBLICATIONS

"The Sinusoidal Transform Coder at 2400 b/s", McAulay, R. J. et al. Communications–Fusing Command, Control and Intelligence, San Diego, Oct. 11–14, 1992, vol. 1, No. CONF. 11, Oct. 11, 1992, pp. 378–380, *Institute of Electrical and Electronics Engineers.*

"The Application of the Imbe Speech Coder to Mobile Communications", Hardwick, J.C. et al. Speech Processing 1, Toronto, May 14–17, 1991, vol. 1, No. CONF. 16, May 14, 1991, pp. 249–252, *Institute of Electrical and Electronics Engineers.*

"Speech Enhancement Using a Soft–Decision Noise Suppression Filter", McAulay & Malpass. *IEEE Transactions on Acoustics, Speech, and Signal Processing,* vol. ASSP–28, No. 2, Apr. 1980, IEEE.

"New Methods of Adaptive Noise Suppression", Arslan, McCree & Viswanathan. ICASSP–95, Detroit, May 1995.

"Suppression of Acoustic Noise in Speech Using Spectral Subtraction", Boll. *IEEE Transactions on Acoustics, Speech, and Signaling Processing,* vol. ASSP–27, No. 2, Apr. 1979.

*Primary Examiner*—David R. Hudspeth
*Assistant Examiner*—Tālivaldis Ivars Šmits
*Attorney, Agent, or Firm*—Wood, Phillips, VanSanten, Clark & Mortimer

[57] ABSTRACT

A system for encoding voice while suppressing acoustic background noise and a method for suppressing acoustic background noise in a voice encoder are described herein. The voice encoder includes a sampler that captures frames of time-domain samples of an audio signal. A voice activity detector operatively coupled to the sampler determines presence or absence of speech in the current frame. A transformer is operatively coupled to the sampler for transforming the frame of time-domain audio samples into an estimate of the power spectrum of that frame. A noise model adapter operatively associated with the transformer updates a frequency-domain noise model based on the power spectrum estimate of the current frame if the voice activity detector indicates an absence of speech in this frame. A filter computation block operatively coupled to the noise model adapter and the transform computes a spectral enhancement (noise suppression) filter based on the current power spectrum estimate and the adapted noise model. A spectral enhancement block operatively coupled to the transformer and the filter computation block applies the spectral enhancement filter to the current power spectrum estimate. A quantizer and encoder block transforms the voice encoder model parameters, including the enhanced spectral magnitudes, into a frame of encoded bits.

43 Claims, 2 Drawing Sheets

INTEGRATED FREQUENCY-DOMAIN VOICE CODING USING AN ADAPTIVE SPECTRAL ENHANCEMENT FILTER

FIELD OF THE INVENTION

This invention relates to systems and methods for encoding speech and, more particularly, to a voice encoder with integrated acoustic noise suppression.

BACKGROUND OF THE INVENTION

While speech is analog in nature, often it is necessary to transmit it over a digital communications channel or to store it on a digital medium. In this case, the speech signal must be sampled and encoded by one of a variety of methods or techniques. Each encoding technique has an associated decoder that synthesizes or reconstructs the speech from the transmitted or stored values. The combination of an encoder and decoder is often referred to as a codec or coder.

There are many well-known techniques in the art of speech coding. These fall broadly into two categories: waveform coding and parametric coding. Waveform coders attempt to quantize and encode the speech signal itself. These techniques are used in most modern public telephone networks and produce high-quality speech at relatively low complexity. However, waveform coders are not particularly efficient, meaning that a relatively large amount of information must be transmitted or stored to achieve a desired quality in the reconstructed speech. This may not be acceptable in some applications where transmission bandwidth or storage capacity is limited.

In general, parametric coders are able to produce a desired speech quality at lower information (or "bit") rates than waveform coders. Each type of parametric coder assumes a particular model for the speech signal, with the model consisting of a number of parameters. In most cases, the parametric model is highly optimized to human speech. The parametric coder receives samples of the speech signal, fits the samples to the model, then quantizes and encodes the values for the model parameters. Transmitting parameter values rather than waveform values enables the efficient operation of parametric coders. However, the optimization of the model for voice can create problems when signals other than or in addition to voice are present. For instance, many parametric coders produce annoying audible artifacts when presented with background noise from a car environment.

Since these artifacts in the reconstructed speech may be unacceptable to a listener, measures must be taken to eliminate or at least mitigate the background noise. One approach is to use a noise suppressor device as a preprocessor to the speech encoder. The noise suppressor receives samples of the noisy speech signal from a microphone or other device, processes the samples, then outputs the speech samples with reduced levels of the background noise. The output samples are in the time domain, and thus can be input to the speech encoder or sent directly to a digital-to-analog converter (DAC) device to synthesize audible speech.

One common method for noise suppression is spectral subtraction, in which models of the background noise and of the composite (or speech-plus-noise) signals are used to construct a linear noise suppression filter. These models typically are maintained in the frequency domain as power spectral densities (PSDs). The noise and composite models are updated when speech is absent and present, respectively, as indicated by a voice activity detector (VAD). The noise suppression input samples are transformed to the frequency domain, the noise suppression filter is applied, and the samples are transformed back to the time domain before being output to speech encoder or DAC.

Parametric voice encoders can be further divided into time-domain and frequency-domain types. Most time-domain parametric encoders are based on a model containing linear prediction coefficients (LPCs). A representative frequency-domain type is the Multi-Band Excitation (MBE) encoder, which includes the well-known IMBE™ and AMBE™ methods. MBE-class encoders utilize a frequency-domain model that includes parameters such as the fundamental frequency (or pitch), a set of spectral magnitudes evaluated at the fundamental and its harmonics, and a set of Boolean values classifying the energy as voiced or unvoiced in each frequency band. Typically, there is a one-to-one correspondence between the respective spectral magnitudes and voiced/unvoiced decisions. MBE-class encoders compute values for the parameters by analysis of a group or frame of samples of the speech signal. The parameter values are then quantized and encoded for transmission or storage.

After close inspection, there are clear similarities between spectral subtraction techniques and frequency-domain voice encoders such as the MBE class described above. Both utilize frequency-domain models; in fact, these models may be very similar depending on the frequencies at which they are evaluated and the model format. Also, both functions disregard the phase of the input signal. The phase of the spectral subtraction input and output are identical, while the frequency-domain decoder may impose arbitrary phase since this information is not in the transmitted model parameters. Finally, both may utilize a VAD, since it may be advantageous to operate the encoder in discontinuous transmission (DTX) mode. The object of the present invention is to exploit these similarities by incorporating spectral subtraction noise suppression in a frequency-domain speech encoder. Such a technique or device has significantly lower complexity than implementing the noise suppressor as a speech encoder preprocessor.

SUMMARY OF THE INVENTION

In accordance with the invention, provided herein is a method for suppressing noise within a voice encoder.

Broadly, there is disclosed herein a system for encoding voice with integrated noise suppression including a sampler which converts an analog audio signal into frames of time-domain audio samples. A voice activity detector operatively coupled to the sampler determines presence or absence of speech in a current frame. A transformer is operatively coupled to the sampler for transforming the frame of time-domain audio samples to a frequency-domain representation. A noise model adaptor operatively associated with the voice activity detector and the transformer updates a noise model using a current audio frame if the voice activity detector determines there is an absence of speech. A transformer and filter creator create a noise suppression filter. A spectral estimator operatively coupled to the transformer and the noise model adaptor removes noise characteristics from the frequency-domain representation of the current frame and develops a set of spectral magnitudes.

It is another feature of the invention that the transformer comprises a discrete Fourier transform that computes a complex spectrum at uniformly spaced discrete frequency points. The transformer further calculates composite power spectral density estimates for the current frame.

It is another feature of the invention that the noise model adaptor computes a model of background noise.

It is another feature of the invention that the transform and filter computation block computes an enhancement filter to suppress the acoustic background noise.

It is a further feature of the invention that the transform and filter computation block includes a transform pair, with one element of the pair transforming the power spectrum estimate of the current frame into a model vector. This model vector is used to adaptively update the noise model vector when there is an absence of speech. The other element of the pair transforms the updated noise model vector into an estimate of the noise power spectrum.

It is a further feature of the invention that the transform and filter computation block uses the updated noise power spectrum estimate and the power spectrum estimate of the current frame of audio samples to compute the aforementioned enhancement filter.

It is yet a further feature of the invention that the noise model adaptor is operative to provide long-term smoothing of noise model parameters.

It is still another feature of the invention that the spectral estimator comprises a spectral enhancer that subtracts a portion of a noise power spectral density from current speech power spectral densities.

Particularly, there is disclosed herein a multi-band excitation voice encoder which integrates a noise suppressor function. This integration improves subjective audio quality for the far end listener with a much lower implementation complexity than functionally separate algorithms. An MBE voice encoder already contains many of the functions needed by spectral subtraction noise suppressors. These include time-frequency transforms, and spectral modeling of the audio signal. This synergy significantly reduces the memory requirements of an implementation. The computational requirements of an integrated solution are less since one time-frequency transform pair has been eliminated.

Further features and advantages of the invention will be readily apparent from the specification and the drawings.

DETAILED DESCRIPTION OF THE INVENTION

Figure 1:
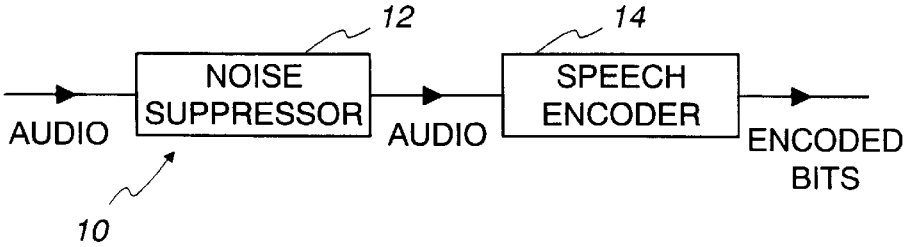
Fig. 1 (Prior Art)
FIG. 1 is a block diagram of a prior art speech encoding system.
Figure 2:
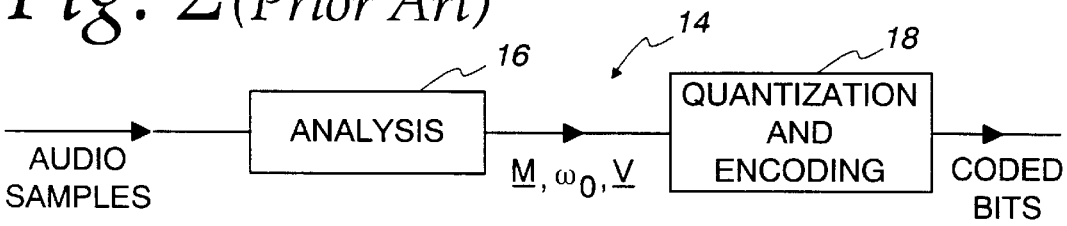
Fig. 2 (Prior Art)
FIG. 2 is a block diagram of a prior art MBE class speech encoder.

Referring initially to FIG. 1, a typical prior art speech encoding system 10 is illustrated. The speech encoding system 10 comprises a noise suppressor 12 and speech encoder 14. The noise suppressor 12 and speech encoder 14 are typically implemented by algorithms operating in microprocessors or digital signal processors. In one form, the speech encoder 14 may comprise a multi-band excitation (MBE) class speech encoder such as shown in FIG. 2. The MBE class speech encoder includes an analysis block 16 which models the speech in the frequency domain using the fundamental frequency $\omega_0$, a set of magnitudes of the input audio spectrum evaluated at the fundamental and harmonic frequencies, represented by the vector M, and a set of voiced/unvoiced decisions for each frequency band, represented by the vector V. These parameters are input to a quantization and encoding block 18 that quantizes them into a discrete set of values and encodes these values into bits for digital transmission.

The present invention is particularly directed to a method of suppressing background noise in a voice encoder and to a voice encoder apparatus with integrated noise suppression. The voice encoder must be based upon a frequency-domain model. Henceforth, the invention will be described using the MBE voice encoder since it is representative of this type. Note that the concepts are readily extrapolated to other frequency-domain voice encoders, e.g., Sinusoidal Transform Coders (STCs).

Figure 3:
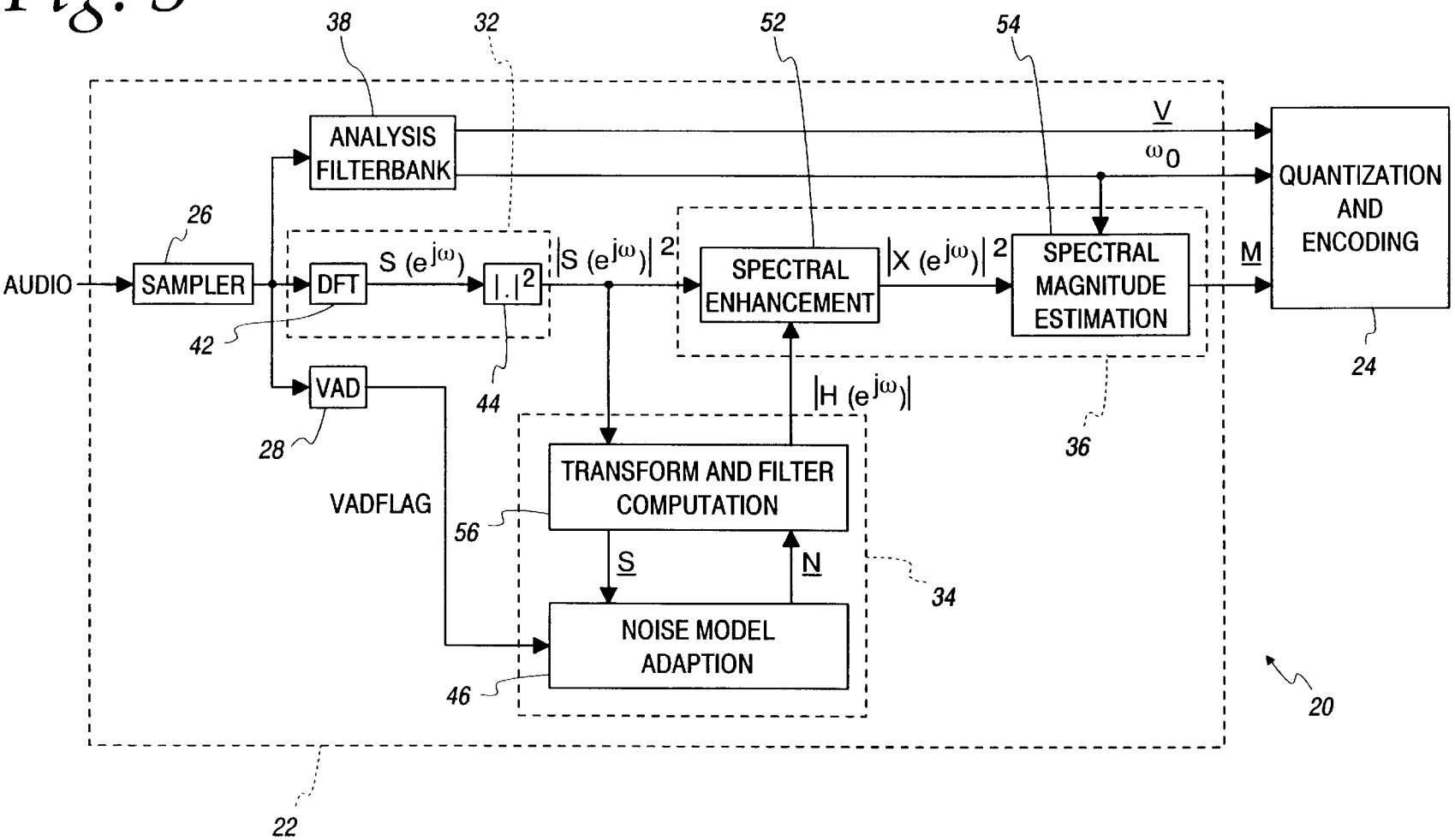
FIG. 3 is a block diagram of a speech encoder with integrated voice suppression according to the invention.

Referring to FIG. 3, a multi-band excitation voice encoder 20 with integrated noise suppression is illustrated. The voice encoder 20 is preferably implemented by a suitable algorithm in a microprocessor or digital signal processor, not shown. The encoder 20 includes an analysis function 22 and a quantization and encoding function block 24.

Audio is input to the system through a microphone or the like to a sampler 26 that converts analog audio signals into frames of time-domain audio samples. A voice activity detector (VAD) 28 receives the audio samples and determines the presence or absence of speech in the current frame, representing this decision by the status of a flag called "vadFlag". A filterbank analyzer 38 receives the current frame of audio samples and computes a set of voiced/unvoiced decisions represented by a vector V, and an estimate of the fundamental frequency, represented by scalar $\omega_0$. A transformer function 32 also receives the current frame of audio samples. The transformer 32 computes an estimate of the power spectrum of these samples. A noise model adapter function 34 updates a noise model vector N using the estimated power spectrum of the current frame, if the vadFlag indicates that there is an absence of speech. The noise model adapter 34 computes a spectral enhancement filter from the updated noise model vector N and the estimated power spectrum of the current frame. A spectral estimator function 36 applies the spectral enhancement filter to the current frame's estimated power spectrum in order to remove or reduce the background noise. Furthermore, the block 36 develops a set of spectral magnitudes, represented by a vector M, from the filtered power spectrum estimate. The quantizer and encoder function 24 transforms the voiced/unvoiced decisions, the fundamental frequency, and the spectral magnitudes into a frame of encoded bits.

More particularly, a block or frame of time-domain audio samples are captured by the encoder 20 using the sampler 26. The frame size is dictated by the stationarity of the audio signal and typically is 20–40 ms in duration. This provides, for example, 160–320 samples at an eight KHz sampling rate.

The audio samples are input to the analysis filterbank 38. The filterbank 38 computes the voiced/unvoiced decision vector V and an estimate of the fundamental frequency $\omega_0$. The analysis filterbank 38 may take any known form. One example of such an analysis filterbank 38 is described in Griffin, European Patent No. EP 722,165.

The audio samples are also input to the voice activity detector 28. The vadFlag output is a Boolean value which is one in the presence of speech in the current frame, or zero in the absence of speech in the current frame. The VAD function 28 may be implemented in any known manner to achieve the desired function. This includes the method described in ETSI Document GSM-06.82, which describes a voice activity detector for the GSM enhanced full-rate voice encoder.

The transformer function 32 includes a discrete Fourier transform (DFT) 42 which receives a frame of time-domain audio samples. The DFT 42 computes the complex spectrum $S(e^{j\omega})$ at K uniformly spaced discrete frequencies, $\omega=\pi i/K$, $0\leqq i<K$. Note that a single-sided, frequency-domain representation is feasible given the complex symmetry produced by real-valued input signals such as audio. The DFT 42 is typically realized by a fast Fourier transform (FFT) algorithm which provides certain implementation advantages. The size of the DFT or FFT is dependent on the audio frame size. For example, a 160-sample audio frame may be transformed by a 256-point FFT, with ninety-six samples from the previous frame included. The output of the DFT 42 is input to block 44 which computes a power spectral density (PSD) estimate for the current frame, represented by $|S(e^{j\omega})|^2$. This PSD estimate is calculated at the same set of discrete frequencies as $S(e^{j\omega})$.

An important aspect of integrating noise suppression into the MBE speech encoder 20 is the computation of a model of the background noise. The noise model in FIG. 3 is represented as a vector N output from a noise model adaptation block 46. This invention is not restricted to any particular method of modeling background noise, and several possible methods are discussed herein. The noise model is stored by the noise model adaptation block 46 and is updated when the vadFlag is set to zero, indicating that there is an absence of speech. The adaptation process involves smoothing of the model parameters in order to reduce the variance of the noise estimate. This may be done using either a moving average (MA), autoregressive (AR), or a combination ARMA process. AR smoothing is the preferred technique, since it provides good smoothing for a low ordered filter. This reduces the memory storage requirements for the noise suppression algorithm. The noise model adaptation with first order AR smoothing is given by the following equation:

$$N^{(i)}=\alpha N^{(i-1)}+(1-\alpha)S,$$

where $\alpha$ may be in the range $0\leqq\alpha\leqq1$, but is further constrained to the range $0.8\leqq\alpha\leqq0.95$ in the preferred embodiment of the invention. The vector S is an input to block 46 from a Transform and Filter Computation block 56. This block 56 also receives as input the noise vector N output from the block 46 and the PSD estimate $|S(e^{j\omega})|^2$ output from the block 44. In addition to S, the block 56 also outputs a filter function $|H(e^{j\omega})|$ which is sampled at discrete frequency points $\omega=\pi i/K$, $0\leqq i<K$.

Figure 4:
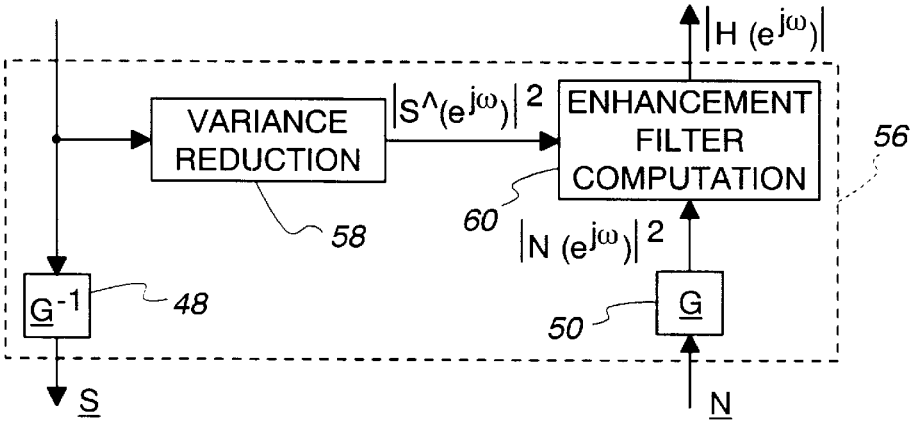
FIG. 4 is an expanded block diagram of a transform and filter computation block of FIG. 3.

FIG. 4 shows the internal structure of the Transform and Filter Computation block 56. This block contains a pair of complementary transform blocks G and $G^{-1}$, denoted by 50 and 48 respectively, a Variance Reduction block denoted by 58, and a Filter Computation block denoted by 60. The inverse transform $G^{-1}$ converts the PSD estimate $|S(e^{j\omega})|^2$ into the vector S that is used by the noise model adaptation. The forward transform G converts the noise vector N into the noise PSD estimate $|N(e^{j\omega})|^2$.

The Variance Reduction block receives as input $|S(e^{j\omega})|^2$ and applies a smoothing function in the frequency domain to generate an output $|S^{\wedge}(e^{j\omega})|^2$. The smoothing reduces the variance of the noise in the power spectrum estimate $|S(e^{j\omega})|^2$, which is due to the finite number of samples in the audio frame used to compute this estimate. As the size of the input frame increases, less smoothing is necessary in block 58. One exemplary smoothing function is given by $$\omega_i=i/n, 0\leqq i<n$$

where n is chosen for the degree of smoothing required. This smoothing function is applied by either linear or circular convolution in the frequency domain with $|S(e^{j\omega})|^2$. Other smoothing functions in which all values are not identical are anticipated.

The smoothed estimate $|S^{\wedge}(e^{j\omega})|^2$ is output from the block 58 into the block 60, which also receives $|N(e^{j\omega})|^2$ from the block 50. These two signals are used to compute the enhancement filter $|H(e^{j\omega})|$ according to the following method:

for i =O . . . K−1, $$|H(e^{j\omega(i)})| = \max\left\{\left(1-\left(\frac{\delta|N(e^{j\omega(i)})|^2}{|S^{\wedge}(e^{j\omega(i)})|^2}\right)^r\right)^s\cdot\eta\right\}$$

end where various combinations of r and s may be chosen. Several possible combinations include {r=1, s=1}, {r=1, s=2}, and {r=2, s=1}, but others are not outside the scope of this invention. The value of the subtraction factor $\delta$ sets the amount of the noise PSD to be subtracted and the subtraction floor $\eta$ limits the amount of subtraction for any frequency. A fixed value of $\eta$ is not required; in fact, varying $\eta$ as a function of frequency may be preferred for some types of background noise. The values of $\delta$ and $\eta$ are related and should be chosen jointly based on the requirements of each application.

The enhancement filter $|H(e^{j\omega})|$ computed by the block 60 is input to the block 52, where it is applied to $|S(e^{j\omega})|^2$ in order to suppress the background noise in this PSD estimate. The enhanced PSD estimate $|X(e^{j\omega})|^2$ is generated according to $$|X(e^{j\omega})|^2=|H(e^{j\omega})||S(e^{j\omega})|^2.$$

The enhanced PSD estimate $|X(e^{j\omega})|^2$ is output from block 52 to the Spectral Magnitude Estimation block 54, of conventional operation. The block 54 computes a set of magnitude parameters, represented by vector M, that are sent as an input to the Quantization and Encoding block 24.

As mentioned above, the noise model can be implemented in numerous different ways. Each has a unique $G/G^{-1}$ transform pair. The principal trade-off between the different models is the complexity of the transform pair versus the memory requirements for storing the noise model vector N. Possible noise models include the following options:

1. The noise model N is identical to $|N(e^{j\omega})|^2$. In this case, the transforms G and $G^{-1}$ are identical. The transform is a trivial identity mapping. This noise model requires the most memory for storage; or
2. The noise model N consists of the spectral magnitudes, $|N(e^{j\omega})|$. While the noise model is evaluated at the same number of discrete frequencies as in option 1, the dynamic range requirement is halved by using magnitudes rather than PSDs. This reduces the memory requirements. In this case, the G and $G^{-1}$ transforms are the square-root and square functions, respectively, applied to each element of the model; or
3. The noise model N consists of the PSD values $|N(e^{j\omega})|^2$ expressed on a logarithmic scale. In this case, the transform pair is given by $$G(N)=(k^N)^2.G^{-1}(|N(e^{j\omega})|^2)=0.5\log_k(|S(e^{j\omega})|^2)$$

where the logarithm base, k, may be chosen based on implementation considerations. The power and logarithm operators are applied to each of the elements of their respective vector arguments; or 4. The noise model N consists of the PSDs evaluated at a smaller number of discrete frequencies than in options 1 through 3. If $|N(e^{j\omega})|^2$ is evaluated at a frequency spacing of $\omega_1$ and N is evaluated at a uniform frequency spacing $\omega_2$, then the transforms G and $G^{-1}$ are an $\omega_2/\omega_1$-rate interpolator and decimator, respectively. For example, N could be stored in the same format as the spectral magnitudes M used by the MBE encoder. In this case, the transform $G^{-1}$ is identical to the spectral magnitude estimation block 54 in FIG. 3. Uniform frequency spacing is not required for the noise model N; in fact, logarithmic spacing may provide some advantages. The memory storage requirements for the noise model N decrease directly with the rate $\omega_1/\omega_2$; or 5. The noise model N is not restricted to the frequency domain; in fact, time-domain models may be advantageous. For instance, N could be a single-sided estimate of the first L values of the autocorrelation function (ACF) of the background noise. In this case, G is a discrete cosine transform (DCT). The elements of the noise PSD, $|N(e^{j\omega(i)})|^2$ are computed by $$|N(e^{j\omega(i)})|^2 = a_i \sum_{k=0}^{L-1} \underline{N}_k \cos\left(\frac{\pi ik}{K}\right), \; 0 \le i < K$$

$$a_1 = \begin{cases} \frac{2}{\sqrt{K}}, & i = 0 \\ \frac{1}{\sqrt{K}}, & i \neq 0 \end{cases}$$

The inverse transform $G^{-1}$ also is a DCT and the elements of S are computed by $$\underline{N}_k = a_k \sum_{i=0}^{K-1} |S(e^{j\omega(i)})|^2 \cos\left(\frac{\pi ik}{K}\right), \; 0 \le k < L$$

$$a_k = \begin{cases} \frac{2}{\sqrt{K}}, & k = 0 \\ \frac{1}{\sqrt{K}}, & k \neq 0 \end{cases}$$

Those skilled in the art will recognize that a DFT or an FFT can be used to implement the transforms G and $G^{-1}$; or 6. Another possible time-domain model for N is a set of linear prediction coefficients (LPCs). In this case, the noise is modeled as an AR random process. The transform $G^{-1}$ incorporates $G^{-1}$ from option 5, followed by a transform such as the Levinson-Durbin algorithm to calculate the LPCs from the estimated ACF. The forward transform G is given by $$\underline{G}(\underline{N}) = \frac{1}{DCT\{\underline{N}\}}$$

where the reciprocal is done element-by-element. The careful reader will recognize that this is the element-by-element reciprocal of G from option 5.

Figure 5:
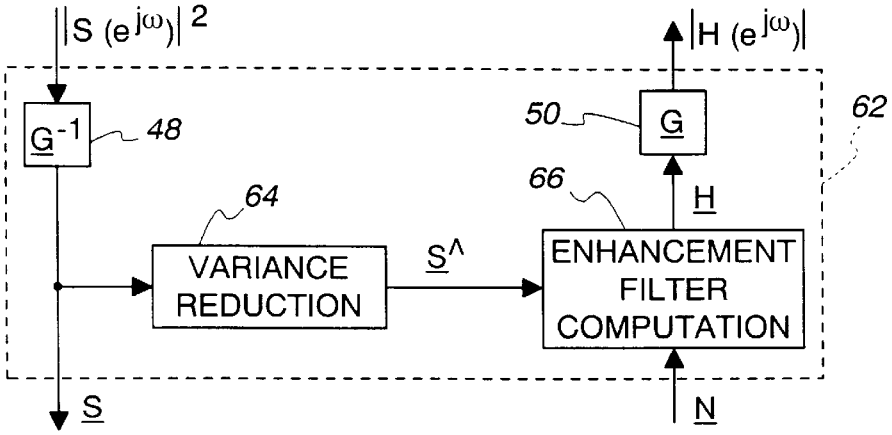
FIG. 5 is an expanded block diagram of an alternative transform and filter computation block.

While the function of the block 56 is applicable to all noise models, it is anticipated that particular models may gain advantages by using an alternate version of the Transform and Filter Computation block. This alternate version is denoted by block 62 and is shown in FIG. 5. The principal novelty of the block 62 versus the block 56 is that the enhancement filter is computed in the domain of the noise model and then transformed to the sampled frequency domain. In FIG. 5, the signal model vector S is input to the Variance Reduction block 64, which outputs a smoothed version of S denoted Ŝ. This vector Ŝ and the noise model vector N are input to the Enhancement Filter Computation block 66. This block 66 computes an enhancement filter vector H that is in the same format as the two input vectors, N and Ŝ. The filter vector H is output from the block 66 into the G transform block 50, which computes the enhancement filter $|H(e^{j\omega})|$ sampled at discrete frequency points ) $\omega = i\pi/K$, $0 \leqq i < K$. Using the block 62 rather than the block 56 is computationally advantageous if the number of elements of the noise model vector N is less than the number of sampled frequency points, K. The noise model described above in option 4 is one such model for which the method of block 62 is advantageous.

As shown, the output of the analysis block 22 is the voiced/unvoiced decision vector V, the selected fundamental frequency $\omega_0$ and the magnitude vector M. These are input to the quantization and encoding block 24. The quantization and encoding block 24 may take any known form and may be similar to that described in Hardwick et al., World Patent No. WO9412972.

Thus, in accordance with the invention there is provided both a system for encoding voice while suppressing acoustic background noise and a method for suppressing acoustic background noise in a voice encoder.

We claim:

1. A system for encoding voice with integrated noise suppression, comprising:

a sampler which converts an analog audio signal into frames of time-domain audio samples;

a voice activity detector operatively coupled to the sampler for determining presence or absence of speech in a current frame;

a transformer operatively coupled to the sampler for transforming the frame of time-domain audio samples to a frequency-domain representation;

a noise model adapter operatively associated with the voice activity detector and the transformer for updating a noise model using a current frame if the voice activity detector determines there is an absence of speech;

a transformer and filter creator operatively coupled to the transformer and the noise model adaptor to create a noise suppression filter; and a spectral estimator operatively coupled to the transformer and the transformer and filter creator to remove noise characteristics from the frequency-domain representation of the current frame using the noise suppression filter and to develop a set of spectral magnitudes.

2. The system of claim 1 wherein said transformer comprises a Discrete Fourier Transform (DFT) that computes a complex spectrum at uniformly spaced discrete frequency points from the frame of audio samples.

3. The system of claim 2 wherein said DFT is computed with a Fast Fourier Transform.

4. The system of claim 1 wherein an output of the transformer comprises a sampled PSD estimate and wherein the transformer and filter creator comprises:

a transform pair for converting between a domain of the noise model adaptor and the domain of the sampled PSD estimate;

a variance reducer for smoothing the sampled PSD estimate of the current audio frame; and a filter creator for computing a noise suppression filter.

5. The system of claim 4 wherein the filter creator computes said noise suppression filter using the PSD estimate of the noise and the PSD estimate of the current frame.

6. The system of claim 4 wherein the variance reducer smooths the PSD estimate of the current frame in the frequency domain before being used to compute the noise suppression filter.

7. The system of claim 6 wherein the variance reducer smooths the PSD estimate of the current frame using a moving average filter operating on the PSD estimate.

8. The system of claim 1 wherein the noise model adaptor stores a vector of noise model parameters.

9. The system of claim 8 wherein the noise model parameters are stored in the same format as a sampled PSD estimate of the current frame output from the transformer.

10. The system of claim 9 wherein the noise model is stored using the same number of points as the PSD estimate, but wherein the value stored represents square roots of the values actually used in the PSD estimate.

11. The system of claim 9 wherein the noise model is stored using the same number of points as the PSD estimate, but wherein the values stored represent the logarithms of the values used in the PSD estimate.

12. The system of claim 9 wherein the noise model is comprised of a set of spectral magnitudes, said magnitudes being equally spaced in the frequency domain and the set comprising a smaller number of magnitudes than the PSD estimate.

13. The system of claim 9 wherein the noise model is comprised of a set of spectral magnitudes, the magnitudes being logarithmically spaced in the frequency domain and the set comprising a smaller number of magnitudes than the PSD estimate.

14. The system of claim 8 wherein the vector of noise model parameters is comprised of a time domain model such as an autocorrelation function (ACF) or a set of linear prediction coefficients (LPCs).

15. The system of claim 1 wherein the noise model adaptor is operative to provide long-term smoothing of noise model parameters.

16. The system of claim 15 wherein said smoothing is implemented by means of an auto-regressive, moving average, or a combination auto-regressive moving average filter.

17. The system of claim 1 wherein the spectral estimator includes a spectral enhancer which applies a noise suppression filter to a PSD estimate of the current audio frame, creating an enhanced PSD estimate.

18. The system of claim 17 wherein the spectral estimator includes a spectral magnitude estimator which accepts as input the enhanced PSD estimate and computes a set of spectral magnitudes.

19. A system for encoding voice with integrated noise suppression, comprising:

a sampler which converts an analog audio signal into frames of time-domain audio samples;

a voice activity detector operatively coupled to the sampler for determining presence or absence of speech in a current frame;

a transformer operatively coupled to the sampler for transforming the frame of time-domain audio samples to a frequency-domain representation;

a noise model adapter operatively associated with the voice activity detector and the transformer for updating a noise model using a current frame if the voice activity detector determines there is an absence of speech;

a transformer and filter creator operatively coupled to the transformer and the noise model adaptor to create a noise suppression filter;

a spectral estimator operatively coupled to the transformer and the noise model adaptor to remove noise characteristics from the frequency-domain representation of the current frame and to develop a set of spectral magnitudes; and a quantizer and encoder for transforming the developed spectral magnitudes into a frame of encoded bits.

20. A system for encoding voice with integrated noise suppression, comprising:

a sampler which converts an analog audio signal into frames of time-domain audio samples;

a voice activity detector operatively coupled to the sampler for determining presence or absence of speech in a current frame;

a transformer operatively coupled to the sampler for transforming the frame of time-domain audio samples to a frequency-domain representation;

a noise model adapter operatively associated with the voice activity detector and the transformer for updating a noise model using a current frame if the voice activity detector determines there is an absence of speech;

a transformer and filter creator operatively coupled to the transformer and the noise model adaptor to create a noise suppression filter; and a spectral estimator operatively coupled to the transformer and the noise model adaptor to remove noise characteristics from the frequency-domain representation of the current frame and to develop a set of spectral magnitudes, wherein the system comprises a multi-band excitation voice encoder.

21. A system for encoding voice with integrated noise suppression, comprising:

a sampler which converts an analog audio signal into frames of time-domain audio samples;

a voice activity detector operatively coupled to the sampler for determining presence or absence of speech in a current frame;

a transformer operatively coupled to the sampler for transforming the frame of time-domain audio samples to a frequency-domain representation;

a noise model adapter operatively associated with the voice activity detector and the transformer for updating a noise model using a current frame if the voice activity detector determines there is an absence of speech;

a transformer and filter creator operatively coupled to the transformer and the noise model adaptor to create a noise suppression filter; and a spectral estimator operatively coupled to the transformer and the noise model adaptor to remove noise characteristics from the frequency-domain representation of the current frame using the noise suppression filter and to develop a set of spectral magnitudes, wherein the system comprises a sinusoidal transform voice encoder.

22. A system for encoding voice with integrated noise suppression, comprising:

a sampler which converts an analog audio signal into frames of time-domain audio samples;

a voice activity detector operatively coupled to the sampler for determining presence or absence of speech in a current frame;

a transformer operatively coupled to the sampler for transforming the frame of time-domain audio samples to a frequency-domain representation;

a noise model adapter operatively associated with the voice activity detector and the transformer for updating a noise model using a current frame if the voice activity detector determines there is an absence of speech, the noise model adapter storing a vector of noise model parameters;

a transformer and filter creator operatively coupled to the transformer and the noise model adaptor to create a noise suppression filter; and a spectral estimator operatively coupled to the transformer and the noise model adaptor to remove noise characteristics from the frequency-domain representation of the current frame and to develop a set of spectral magnitudes, wherein the voice encoder comprises a multi-band excitation (MBE) voice encoder and wherein the noise model is stored in the same format as the spectral magnitudes of the MBE model.

23. A system for encoding voice with integrated noise suppression, comprising:

a sampler which converts an analog audio signal into frames of time-domain audio samples;

a detector operatively coupled to the sampler for determining presence or absence of speech in a current frame;

a transformer operatively coupled to the sampler for transforming the frame of time-domain audio samples to a frequency-domain representation;

a noise model adapter operatively associated with the voice activity detetor and the transformer for updating a noise model using a current frame if the voice activity detector determines there is an absence of speech;

a transformer and filter creator operatively coupled to the transformer and the noise model adapter to convert between a domain of the noise model adapter and the frequency-domain representation and to create a noise suppression filter;

a spectral estimator operatively coupled to the transformer and the noise model adaptor to remove noise characteristics from the frequency-domain representation of the current frame using the noise suppression filter; and an encoder transformer coupled to the spectral estimator for transforming the frequency-domain representation of the current frame, having noise characteristics removed, into a frame of encoded bits.

24. A method of suppressing noise in a voice encoder, comprising the steps of:

converting a received analog audio signal into frames of time-domain audio samples;

determining presence or absence of speech in a current frame of the time-domain audio samples;

transforming the frame time-domain audio samples to a frequency-domain representation;

updating a noise model using the transformed current frame if there is an absence of speech creating a noise suppression filter from the frequency-domain representation; and removing noise characteristics from the frequency-domain representation of the current frame using the noise suppression filter and developing a set of spectral magnitudes.

25. The method of claim 24 wherein said transforming step uses a Discrete Fourier Transform (DFT) that computes a complex spectrum at uniformly spaced discrete frequency points from the frame of audio samples.

26. The method of claim 25 wherein said DFT is computed with a Fast Fourier Transform.

27. The method of claim 24 wherein the transforming step develops a sampled PSD estimate and wherein the creating step uses:

a transform pair for converting between the domain of the noise model and the domain of the sampled PSD estimate;

a variance reducer for smoothing the sampled PSD estimate of the current frame; and a filter creator for computing a noise suppression filter.

28. The method of claim 27 wherein the filter creator computes said noise suppression filter using the PSD estimate of noise and the PSD estimate of the current frame.

29. The method of claim 27 wherein the variance reducer smooths the PSD estimate of the current frame in the frequency domain before being used to compute the noise suppression filter.

30. The method of claim 29 wherein the variance reducer smooths the PSD estimate of the current frame using a moving average filter operating on the PSD estimate.

31. The method of claim 24 wherein the updating step stores a vector of noise model parameters.

32. The method of claim 31 wherein the noise model parameters are stored in the same format as a sampled PSD estimate of the current audio frame developed in the transforming step.

33. The method of claim 32 wherein the noise model is stored using the same number of points as the PSD estimate, but wherein the value stored represents square roots of the values actually used in the PSD estimate.

34. The method of claim 32 wherein the noise model is stored using the same number of points as the PSD estimate, but wherein the values stored represent the logarithms of the values used in the PSD estimate.

35. The method of claim 32 wherein the noise model is a set of spectral magnitudes, said magnitudes being equally spaced in the frequency domain and the set comprising a smaller number of magnitudes then the PSD estimate.

36. The method of claim 32 wherein the noise model is a set of spectral magnitudes, the magnitudes being logarithmically spaced in the frequency domain and the set comprising a smaller number of magnitudes than the PSD estimate.

37. The method of claim 31 wherein the vector of noise model parameters is comprised of a time domain model such as an auto-correlation function (ACF) or a set of linear prediction coefficients (LPCs).

38. The method of claim 24 wherein the updating step provides long-term smoothing of noise model parameters.

39. The method of claim 38 wherein said smoothing is implemented by means of an auto-regressive, moving average, or a combination auto-regressive moving average filter.

40. The method of claim 24 wherein the removing step uses a spectral enhancer which applies a noise suppression filter to a PSD estimate of the current audio frame, creating an enhanced PSD estimate.

41. The method of claim 40 wherein the spectral estimator includes a spectral magnitude estimator which accepts as input the enhanced PSD estimate and computes a set of spectral magnitudes.

42. Method of suppressing noise in a voice encoder, comprising the steps of:

converting a received analog audio signal into frames of time-domain audio samples;

determining presence or absence of speech in a current frame of the time-domain audio samples;

transforming the frame time-domain audio samples to a frequency-domain representation;

updating a noise model using the transformed current frame if there is an absence of speech;

creating a noise suppression filter from the frequency-domain representation;

removing noise characteristics from the frequency-domain representation of the current frame and developing a set of spectral magnitudes; and transforming the developed spectral magnitudes into a frame of encoded bits.

43. A method of suppressing noise in a voice encoder, comprising the steps of:

converting a received analog audio signal into frames of time-domain audio samples;

determining presence or absence of speech in a current frame of the time-domain audio samples;

transforming the frame time-domain audio samples to a frequency-domain representation;

updating a noise model using the transformed current frame if there is an absence of speech, wherein the updating step stores a vector of noise model parameters;

creating a noise suppression filter from the frequency-domain representation; and removing noise characteristics from the frequency-domain representation of the current frame and developing a set of spectral magnitudes, wherein the voice encoder comprises a multi-band excitation (MBE) voice encoder and wherein the noise model is stored in the same format as the spectral magnitudes of the MBE model.

* * * * *